United States Patent [19]

Mosse

[11] Patent Number: 4,805,380

[45] Date of Patent: Feb. 21, 1989

[54] METHOD OF AND AN APPARATUS FOR PREFORMING OPERATIONS IN RELATION TO A CONTAINER SLEEVE

[75] Inventor: Richard W. E. Mosse, London, England

[73] Assignee: Liquipak International B.V., London, England

[21] Appl. No.: 901,424

[22] Filed: Aug. 28, 1986

[51] Int. Cl.[4] ..... B65B 43/26; B65B 59/00

[52] U.S. Cl. ..... 53/458; 53/244; 53/468; 53/563; 53/565; 493/165; 493/176

[58] Field of Search ..... 53/458, 565, 563, 240, 53/167, 468, 244; 493/176, 165, 164, 163, 184, 180, 175

[56] References Cited

U.S. PATENT DOCUMENTS

| | | | |
|---|---|---|---|
| 3,280,531 | 10/1966 | Meyer-Jagenberg | 53/565 X |
| 3,579,958 | 5/1971 | Hentges et al. | 53/565 |
| 4,448,013 | 5/1984 | Nakajima | 53/565 |
| 4,566,251 | 1/1986 | Spisak et al. | 53/167 |
| 4,588,391 | 5/1986 | Evans et al. | 53/565 X |

*Primary Examiner*—James F. Coan

*Attorney, Agent, or Firm*—Wood, Dalton, Phillips, Mason & Rowe

[57] ABSTRACT

A rotary packaging machine advances carton sleeves stepwise through a series of stations at which various operations are performed in relation to the sleeves. At certain earlier ones of the stations operations are performed upon the bottoms of the sleeves at a desired common level. At certain later ones of the stations operations are performed upon the tops of the sleeves at a higher desired common level. At one station intermediate the earlier ones and later ones, the sleeves are lowered by an amount dependent upon their heights, so as to bring their tops to that higher desired common level.

19 Claims, 10 Drawing Sheets

METHOD OF AND AN APPARATUS FOR PREFORMING OPERATIONS IN RELATION TO A CONTAINER SLEEVE

BACKGROUND OF THE INVENTION

1. Field of the Invention

This invention relates to a method of and an apparatus for performing operations in relation to a container sleeve, in particular to a rotary machine for packaging liquid in cartons.

2. Description of the Prior Art

U.S. Pat. No. 3,579,958 discloses a rotary packaging machine for automatically forming, filling and sealing carton sleeves. The machine includes a rotary spider that holds the sleeves upright in holding devices at the ends of its horizontal arms and advances them stepwise through various operating stations of the machine. Each holding device includes a mounting block attached to the end of a spider arm, and a generally U-shaped holder fixed to the block and consisting of a backing plate and a pair of side flanges extending normally outward from the plate. The holder embraces the sleeve and has a width and depth slightly larger than the outer horizontal dimensions of the open sleeve. The holder is designed for use with carton sleeves of similar cross-section but various lengths, such as half-pint, pint, and quart size cartons. A second such U-shaped holder is suspended by links from the block and can be swung from a position beneath the first holder for embracing the lower part of a larger size, for example the quart size, sleeve into an out-of-the-way position. A locking lip extends obliquely from one of the side flanges of each holder towards the other side flange thereof to lock and hold the sleeve in an open and upright position.

The stations of the machine are, in turn, a loading station, a bottom closure heating station, a bottom closure folding and sealing station, a top closure pre-breaking station, a filling station, a top closure heating station, a top closure folding and sealing station and a discharge station.

At the bottom closure folding and sealing station a vertical mandrel having a head of a cross-sectional dimension slightly less than the internal dimensions of the carton sleeve is lowered by an hydraulic cylinder through the sleeve until the lower surface of the head is at the level of the sleeve bottom closure sub-panels. The stroke of the mandrel is adjustable so that the lower end position of the lower surface of the head is adjustable depending upon the height of the carton sleeve. Also at this station are a lock member mounted on a yoke through which the mandrel extends, and a press head secured to the upper end of a vertically reciprocating rod of an hydraulic cylinder fixed to a platform beneath the mandrel. A pair of folding plates are pivotally mounted upon the platform and are operable by movement of the press head towards and away from the sleeve, as also are a pair of roller bars. The level of the platform is vertically adjustable to allow for the various heights of the sleeves.

At the filling station, the open-topped carton is filled with a controlled quantity of liquid. The station includes a supply tank, a filling stem, and a dispensing valve for controlling the flow of liquid to the carton. A carton-operated time-control switch comprises electrical circuits which actuate the dispensing valve and automatically shut it off after a prescribed period of time corresponding to the volume of flow desired.

Machine cycling means are provided for rotating the spider stepwise and for actuating and controlling the various mechanism at the operating station. This means includes an indexing device connected to the driving axle of the spider for rotating the same, and electric and pneumatic control circuits for actuating hydraulic cylinders and other mechanisms at the stations.

This prior machine has a number of disadvantages. Firstly, when changing from handling sleeves of one height to sleeves of another height, a considerable amount of adjustment is required at various stations, which necessitates a considerable degree of complication in the designs of the stations affected and a substantial loss of production time. Secondly, the locking lips of the holders are liable to distort or damage the sleeves. Thirdly, although it is obviously desirable that the head of the mandrel should fit as snugly into the sleeve interior as possible in order to promote accurate folding of the closure sub-panels, the slight looseness of the sleeve in the holder and the normally inherent tendency for it to move out of its rectangular state mean that the mandrel head has to be undesirably smaller in external cross-section than the internal cross-section of the sleeve, otherwise the descending mandrel engages the top edge of the sleeve and crushes it. Fourthly, on the one hand the sealing pressure of the press head upon the bottom closure sub-panels should be relatively high, but, on the other hand, the higher the pressure required, the larger and more costly will be the hydraulic apparatus for operating the mandrel. Fifthly, time control of filling of a container is often unreliable in respect of the volume actually supplied, which is liable to vary with the viscosity of the liquid for example. Sixthly, at the discharge station, cartons of various heights will have their bottoms at various levels, which would create problems for their reception by a discharge conveyor. Seventhly, there is the risk of the mandrel descending dangerously should the pressure fluid supporting the mandrel discharge inadvertently. Eighthly, the passing of the mandrel through the yoke would make it more difficult to maintain aseptic if the machine were to be an aseptic packaging machine. Ninthly, the drive system used in the machine leads to motion patterns which tend to produce shock and vibration.

SUMMARY OF THE INVENTION

According to a first aspect of the present invention, there is provided a method of performing operations in relation to a container sleeve, comprising performing an operation upon a lower end of the sleeve, lowering the sleeve and then performing an operation upon an upper end of the sleeve.

According to a second aspect of the present invention, there is provided apparatus comprising means for performing an operation upon a lower end of a container sleeve, lowering means for lowering the sleeve after the performance of said operation, and means for performing an operation upon an upper end of the sleeve after the lowering of the sleeve.

In an arrangement where container sleeves of differing heights are handled on different occasions, and in which, after performance of an operation upon a lower end of each sleeve, the sleeve is lowered and then an operation is performed upon its upper end, with the sleeve being held at the desired level by being gripped laterally in a frictional manner, there is advantageously some supporting means which is located beneath the sleeves but which supports only the tallest sleeves in their lowered positions. This supporting means advantageously moves with conveying means for the sleeves.

According to a third aspect of the present invention, there is provided apparatus for retaining a carton sleeve which has been made by folding sheet material but which has an inherent tendency to unfold, comprising retaining means for retaining said sleeve in a desired position, said retaining means including a releasable latching member for releasably bearing against an external surface portion of said sleeve which tends to move outwardly under said tendency, and mounting means which mounts said member for displacement to release said sleeve.

This arrangement has the advantage that the sleeve can be released from engagement by the latching member without the latter distorting or damaging the sleeve.

According to a fourth aspect of the present invention, there is provided apparatus including, at a common station, means for folding, towards a closed position thereof, a closure sealing sub-panel of a carton sleeve having surfaces of a material which can be rendered tacky by heating, and means for heating said sub-panel to render tacky a surface portion thereof.

According to a fifth aspect of the present invention, there is provided apparatus for performing an operation upon a carton sleeve at an operating station, including a member for being received in an end of said sleeve and of a section, in a transverse plane of said sleeve, of a shape and size to be received closely in the internal cross-section of said end and means arranged to bear externally upon said sleeve at said end in such a manner that the internal cross-section of said sleeve is of a shape to receive said member, said member and means being movable to permit the sleeve to be moved, for example horizontally and transverse to the axis of the sleeve, into and out of said operating station.

According to a sixth aspect of the present invention, there is provided a method of performing an operation upon a carton sleeve, including moving the sleeve to an operating station, causing at said station a member to be received in an end of the sleeve so that said member is closely received in the internal cross-section of said end, at said station and immediately prior to such reception, bearing externally upon said sleeve in such a manner that the internal cross-section of said sleeve is of a shape to receive said member, and moving the sleeve away from said station.

This arrangement has the advantage that the member can be of cross-sectional dimensions to fit snugly in the sleeve, without risk of the member damaging the end of the sleeve.

According to a seventh aspect of the present invention, there is provided apparatus for use in performing an operation upon a container sleeve, including a support, a press member displaceable longitudinally for applying pressure to portions of said sleeve, a toggle device comprising first and second interarticulated links of which the first is connected to the support and the second is connected to the member, and driving means connected to the first and second links in the zone of interarticulation for displacing said links so as to displace said member longitudinally.

This apparatus has the advantage that the driving means can be relatively small and cheap and yet produce a relatively high pressure at the pressure surface of said member.

When this apparatus is applied to an aseptic packaging machine having an aseptic chamber in which the operation is performed, the press member is situated within the chamber, the toggle device is situated outside the chamber, and an elongate member extending sealingly through a wall of the chamber connects the press member to the toggle device.

According to an eighth aspect of the present invention, there is provided a method of filling containers of which some have a contents volume a multiple of that of others, comprising, for each container having the minimum contents volume, operating once only a dosaging device having a filling volume equal to said minimum contents volume and, for each of said other containers, operating said dosaging device said multiple of times.

This method utilized volume control, which is highly reliable as regards the volume actually supplied.

According to a ninth aspect of the present invention, there is provided a method of performing operations in relation to containers of differing heights, comprising advancing the containers towards an ejection station with their tops at a substantially identical level irrespective of their heights and advancing the containers away from the ejection station with their bottoms at a substantially identical level irrespective of their heights.

According to a tenth aspect of the present invention, there is provided apparatus for performing operations in relation to containers of differing heights, comprising a zone, conveying means for advancing said containers towards said zone and away from said zone, and means to cause the tops of the containers as they approach said zone to be at a substantially identical level irrespective of the heights of the containers and to cause the bottoms of the containers as they leave said zone to be at a substantially identical level irrespective of the heights of the containers.

This feature of the container bottoms leaving at a substantially identical level irrespective of the height of the containers simplifies any arrangement for further conveying of the containers.

According to an eleventh aspect of the present invention, there is provided apparatus for use in performing operations in relation to a container sleeve, comprising a mandrel mounted so as to be displaceable up and down for lowering longitudinally into said sleeve, driving means operable by fluid pressure to raise said mandrel, a fluid pressure line for supplying said fluid to said driving means, an exhaust for allowing said fluid to escape from said driving means on lowering of said mandrel, an openable safety guard which in a closed position is interposed between said mandrel and an operator, and valve means arranged in said exhaust and so connected to said guard as to close said exhaust upon opening of said guard.

This arrangement avoids any danger from inadvertent discharge of the fluid.

According to a twelfth aspect of the present invention, there is provided apparatus for use in performing operations in relation to a container sleeve, comprising a tubular mandrel closed at an end and for entering longitudinally into said sleeve, elongate guide means arranged substantially co-axially in said mandrel for guiding reciprocation of said mandrel along said guide means, and drive means arranged to reciprocate said mandrel along said guide means.

This arrangement reduces the risk of contamination of the inside surface of the sleeve and simplifies cleaning of the mandrel.

According to a thirteenth aspect of the present invention, there is provided apparatus for use in performing operations in relation to container sleeves, comprising a mandrel mounted so as to be displaceable up and down for lowering longitudinally into such sleeve, mandrel driving means connected to said mandrel for displacing said mandrel up and down, stepping conveying means arranged beneath said mandrel for advancing the sleeves stepwise in turn to and from a stationary position substantially co-axial with said mandrel, second driving means connected to said stepping conveying means for advancing the latter stepwise, and common driving means arranged to drive the mandrel driving means and the second driving means, these three driving means being such as to produce controlled motion patterns of said mandrel and said stepping conveying means in which the reciprocatory cycle frequency of the mandrel equals the stepping frequency of the stepping conveying means, with an upper dwell and a lower dwell for the mandrel, and the stepping motion of the stepping conveying means occurring at the upper dwell.

Such controlled motion patterns permit shock and vibration to be minimized.

BRIEF DESCRIPTION OF THE DRAWINGS

In order that the invention may be clearly understood and readily carried into effect, reference will now be made, by way of example, to the accompanying drawings, in which.

DESCRIPTION OF THE PREFERRED EMBODIMENTS

Figure 1:
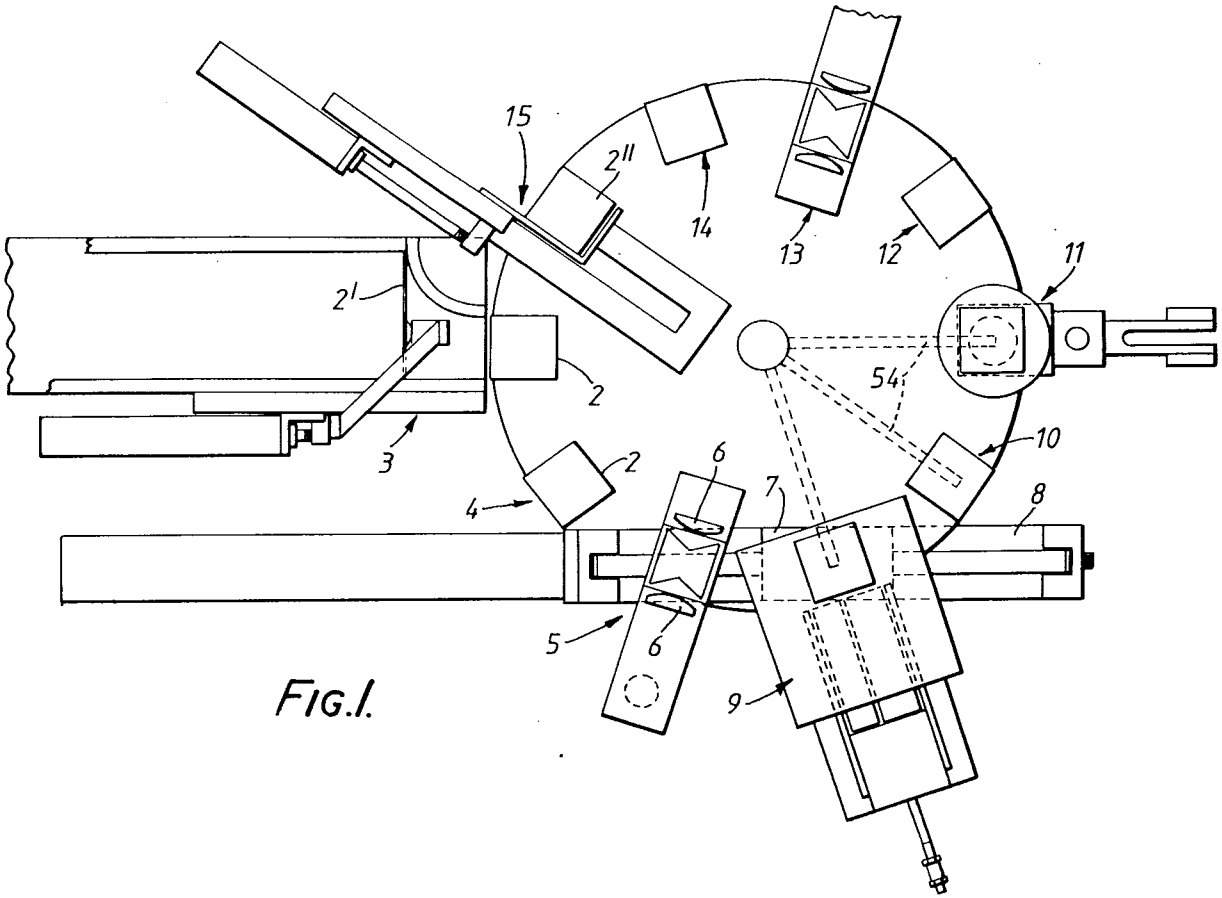
FIG. 1 shows a diagrammatic plan view of a rotary packaging machine.

Referring to FIGS. 1 to 16 of the drawings, in particular FIG. 1, the machine includes a horizontal rotary table 1 in the outer periphery of which are formed a plurality of radially outwardly opening rectangular pockets, in FIG. 1 ten pockets, for receiving vertical rectangular carton sleeves 2. There are an equal number of stations distributed around the table 1, at some or all of which stations various operations may be performed in relation to the carton sleeves. The carton sleeves have been cut and folded from sheet material consisting of paperboard coated on both faces with a plastics material. Sleeves 2' of a flat form are opened and loaded into a table pocket at an opening and loading station 3. The table 1 rotates stepwise (36° at each step) and a sleeve 2 is advanced to a bottom closure pre-breaking station 4 at which the bottom closure of the sleeve is pre-broken. Then the sleeve is advanced through another step to a bottom heating and folding station 5, at which the appropriate surfaces of sealing sub-panels of the carton bottom closure are heated to a tacky consistency and immediately thereafter the bottom closure sub-panels are folded in by devices 6, which could be plates or tubes through which a coolant is passed. The sleeve is then advanced to a station 9, the bottom closure sliding across the top of a stationary flat and horizontal plate (not shown) which prevents the bottom closure opening again whilst the sleeve travels from station 5 to station 9. The station 9 is a bottom closure sealing and top closure pre-breaking station at which bottom closure sealing sub-panels have their tacky surfaces pressed together to seal the bottom of the sleeve. The sleeve is then advanced one step to a positioning and coding station 10 and one more step to a filling station 11. The sleeve is then advanced one step to a further station 12 which may be either a spare station for performing some additional operation in relation to the sleeve, or a second filling station in which partially-filled cartons of a larger size are completely filled. Thence, the sleeve advances one step to a top closure heating and folding station 13, at which appropriate surfaces of top closure sealing sub-panels of the filled sleeve are heated to a tacky consistency and the top closure sub-panels are folded into almost their closed condition. Then the sleeve is advanced one step to a top closure sealing station 14 at which a top sealing fin is formed by pressing sealing sub-panels of the top closure together. The filled carton 2'' is now advanced to an ejection station 15, at which the carton 2'' is ejected from the machine. In FIG. 1, the station 15 is located next to the station 3. It is possible to have a number of stations different from ten equi-distantly distributed stations. For example, there could be twelve equi-distantly distributed stations, with an idle station interposed between the stations 9 and 10 and a spare station interposed between the stations 15 and 3.

Figure 2:
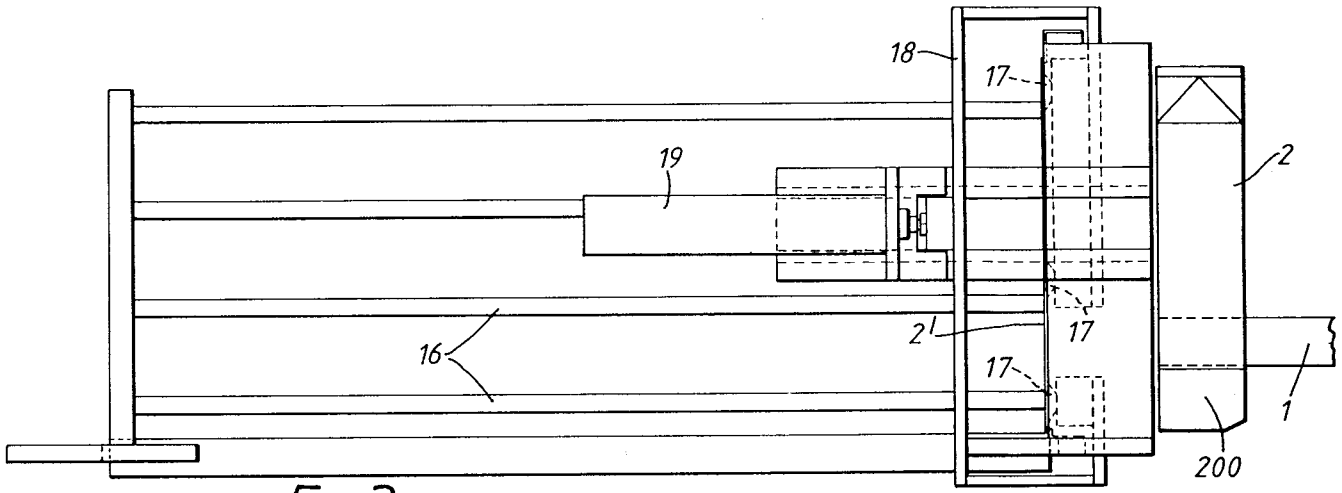
FIG. 2 shows a diagrammatic side elevation of a carton sleeve introduction and opening station of the machine.
Figure 3:
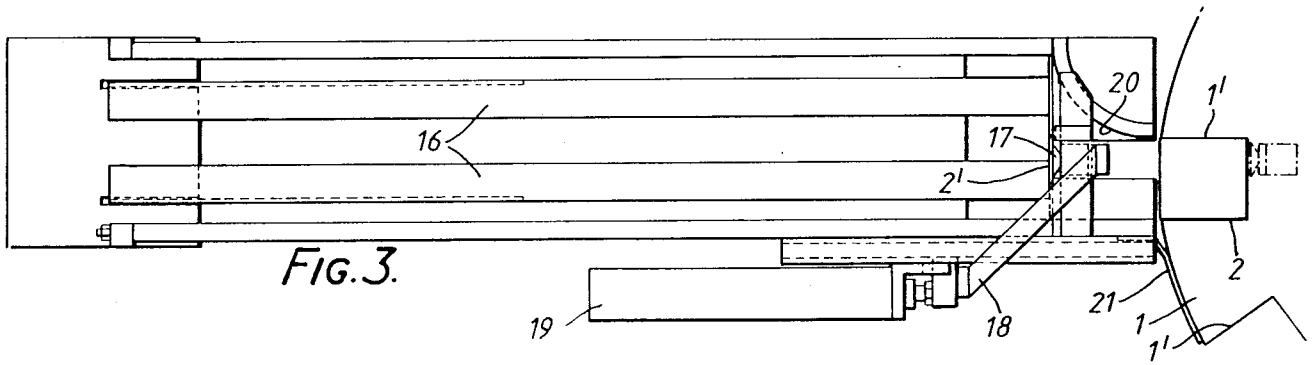
FIG. 3 shows a diagrammatic plan view of that station.

The station 3 is shown in more detail in FIGS. 2 and 3, in which a block of flat-form sleeves in a substantially upright condition is guided along horizontal rails 16 to an opening-out location at which is initially situated a vertical line of suction cups 17 carried by a yoke 18 attached to the piston of a pneumatic piston-and-cylinder device 19. The suction cups 17 seize one of the four vertical major panels of the flat-form sleeve 2'. At that location, an adjacent panel of those four panels bears against the starting zone of a curved guide surface 20. Thus, upon the device 19 moving the yoke 18 in a radially inward direction with respect to the table 1, the suction cups 17 draw the one panel towards the center of the table 1, while the adjacent panel is cammed by the surface 20 finally into a position in which it is at right angles to the o ne panel, the other two panels accordingly being forced into positions in which the rectangular sleeve is fully open, as indicated at 2 in FIGS. 2 and 3. The continuing movement of the yoke 18 draws this sleeve into one of the pockets 1' in the table 1, until the sleeve 2 is fully received in the pocket 1', the pocket 1' extending over a vertical zone immediately above the bottom closure sub-panels 200 of the sleeve 2. A resilient strip 21 extending along the periphery of the table 1 in its direction of rotation serves to ensure that the sleeve 2 is pressed firmly into its pocket as it passes the strip 21.

In order to maintain the sleeve 2 frictionally in the pocket 1', it is possible to mount, on the table 1, adjacent each pocket and at the mouth of the pocket a latch which, during insertion of the sleeve into the pocket, does not obstruct such insertion but, once the sleeve has been fully inserted, presses externally on the radially outermost panel of the sleeve 2 to press the radially innermost panel of the sleeve against the radially innermost surface of the pocket. In this manner, the sleeve 2 is frictionally retained in its vertical position in the pocket. Because the sleeve has been made by folding laminate material, it has an inherent tendency to unfold and thus a tendency to move out of its rectangular state. For this reason, the latch is advantageously arranged to engage that one of the radially outer corners of the sleeve which tends to move outwardly of this sleeve under that inherent tendency.

Figure 4:
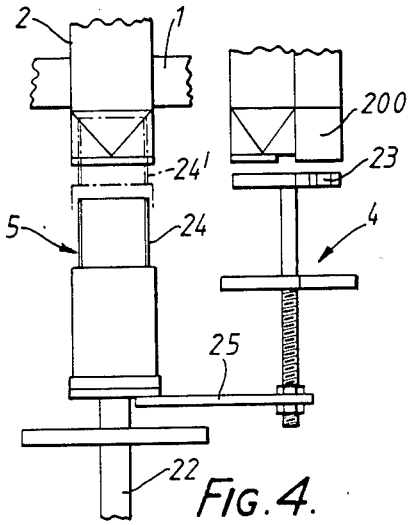
FIG. 4 shows a diagrammatic fragmentary side elevation of a bottom closure pre-breaking station and a bottom closure heating station of the machine.
Figure 5:
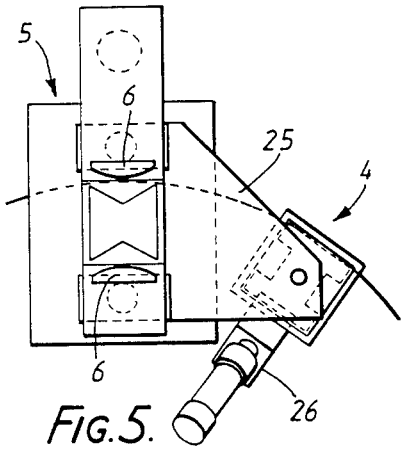
FIG. 5 shows a diagrammatic plan view of those stations.

The stations 4 and 5 are shown in more detail in FIGS. 4 and 5. Fixed to a piston rod 22 of a pneumatic piston-and-cylinder device is a mandrel 23 of the station 4 and a heating element 24 of the station 5. The mandrel 23 is attached to the rod 22 by way of a horizontal arm 25. By means of the rod 22, the mandrel 23 and the element 24 are inserted simultaneously into respective cartons, the inserted condition of the element 24 being indicated at 24'. Once the mandrel 23 has been inserted to a position immediately above the sub-panels 200 and thus within the pocket 1', the sub-panels 200 are pre-broken by a pair of pneumatically-operated plungers, of which one is indicated at 26 in FIG. 5.

The station 9 is shown in more detail in FIGS. 6 to 9. It includes a stationary support 27 on which is mounted a pair of toggles 28 including respective upper links 29 and respective lower links 30. The toggles are arranged at respective opposite sides of a vertical rod 31 which is movable vertically. The rod 31 extends vertically through a yoke 32 to which are fixed respective pistons of respective pneumatic piston-and-cylinder devices 33, of which the cylinders are articulated to the links 29 and 30. The upper end of the rod 31 is guided for vertical movement in a sleeve 34 fixed to the support 27, whilst the lower end of the rod 31 is fixed to a crosspiece 35 to which is fixed the upper end of a mandrel 36 which consists of a vertical stem 37 of cruciform cross-section and a pressing head 38 of a cross-section which fits relatively closely within the sleeve 2. The stem 37 is formed with a vertical slot 39 in which can be moved up and down a nut and bolt device 40 which serves to clamp to the stem 37 a two-part, square sleeve 41, the lower end of which is formed as a pair of mandrels 42 for co-operating with a pair of pneumatically-operated plungers (of which one is shown and referenced 43) for use in pre-breaking the sub-panels of the top closure of the sleeve 2. Each of these plungers is mounted upon the sleeve 41. By adjusting the position of the sleeve 41 up and down the stem 37, the level of the pre-breaking device 42, 43 can be adjusted to suit the height of the sleeves being handled at any one time. At the bottom of the support 27 is a fixed block 44 with which the head 38 co-operates to press together the tacky surfaces of the bottom closure sub-panels. By operation of the devices 33, the mandrel 36 can be raised to allow a sleeve 2 to come directly vertically beneath it and can then be lowered downwardly to the bottom of the sleeve. It is of importance therefore that the top zone of the sleeve, which is not confined within a table pocket, as is the bottom zone thereof, should not be significantly out of square owing to the inherent tendency mentioned above, and, for that reason, it is important that the upper end zone of any sleeve which is out of square should be brought to its square condition before the mandrel is lowered. For that reason, it is advisable to provide a pair of jaws (shown diagrammatically at 55 in FIG. 8) of which the two jaws are respectively horizontally displaceable by two hydraulic piston-and-cylinder devices 56 to cause them to engage those corners of the upper zone which tend to move outwardly, in order to bring the upper zone into its square condition. In each case, the corners in question will naturally have been the two vertical edges of the flat-form sleeve 2'. In order to prevent the mandrel 36 from descending before the jaws are in the square condition, their arrival in the squared condition can be detected by some means, for example reed switches, which until then prevent operation of the devices 33. In order that the forces produced by the devices 33 through the toggles should not become excessive, and in order to avoid the toggles becoming inoperative, the links 29 and 30 should not move outside a range of between 15° and 85° to the horizontal. Moreover, to prevent accidental injury to the operator or other individual, a safety guard (shown diagrammatically at 60 in FIG. 6) is interposed between the operator and the mandrel 36. However, the safety guard 60 will need to be moved away to allow access to the mandrel area for cleaning and maintenance purposes and, in order to avoid any danger of the compressed air exhausting from the devices 33 and thus allowing the mandrel 36 to drop under gravity, there is provided an interlock device 61 between the guard and exhaust valves 62 of the compressed air circuits of the devices 33 to prevent air escaping from the circuits when the guard 60 is open.

Figure 10:
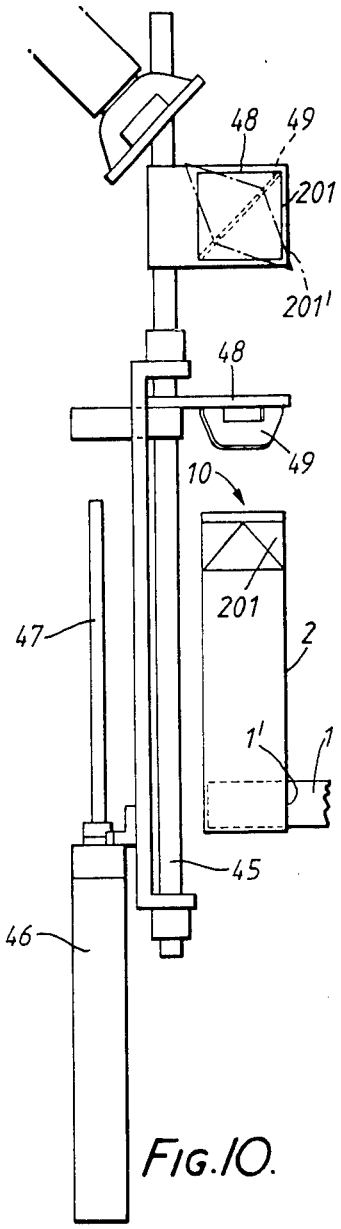
FIG. 10 shows a diagrammatic side elevation of a positioning and coding station.
Figures 6, 7, 8, 9:
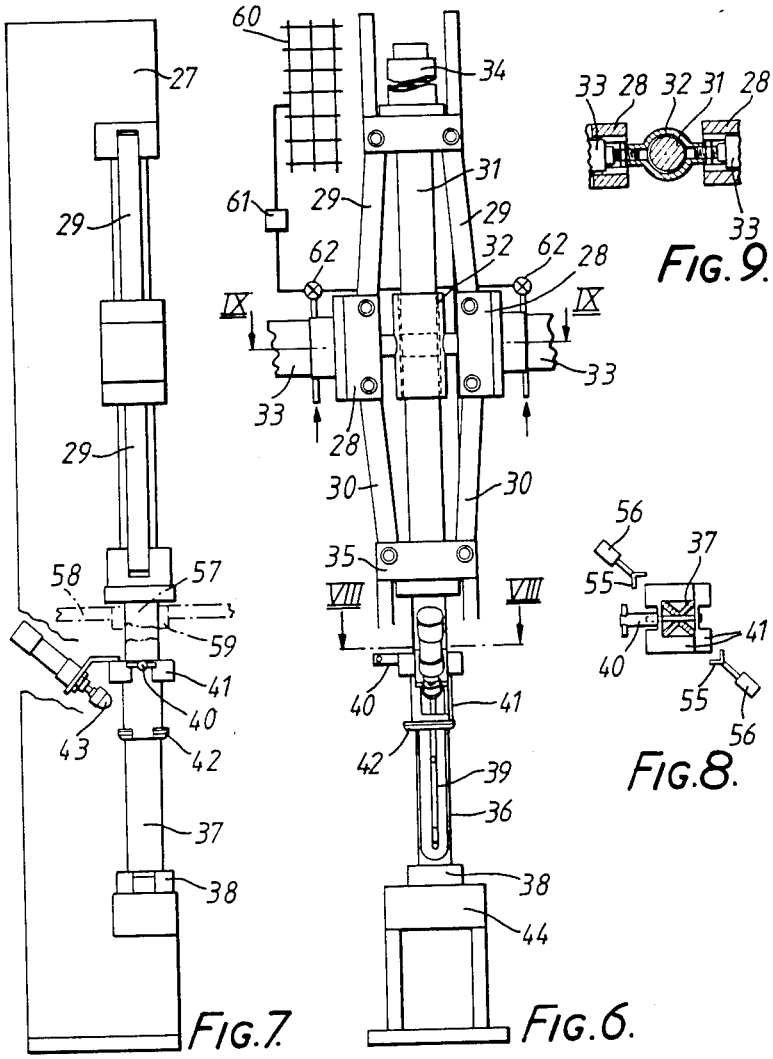
FIG. 6 shows a diagrammatic front elevation of a bottom closure sealing and top closure pre-breaking station of the machine.
FIG. 7 shows a diagrammatic side elevation of that station.
FIG. 8 shows a section taken on the line VIII—VIII of FIG. 6.
FIG. 9 shows a section taken on the line IX—IX of FIG. 6.

A mechanism performing the positioning function of the positioning and coding station 10 is shown in more detail in FIG. 10. A vertical stationary rod 45 has fixed thereto a vertical piston-and-cylinder device 46 to the upper end of the piston rod 47 of which is fixed an arm 48 which has fixedly depending therefrom a vertical lug 49 which, on being lowered into the open top of the sleeve 2 can bring any upper zone which is in an out-of-square condition 201' into a squared condition 201, the upper part of FIG. 10 including a top plan view for illustrating this feature. However, the main purpose of the mechanism shown in FIG. 10 is to lower the sleeves 2 until their tops are at an identical level irrespective of the height of sleeve 2 being handled at any one time. This avoids the subsequent stations 11 to 14 having to have height adjustments made to them depending upon whether the sleeves are tall or short. In fact, the only significant adjustment required to change the machine over from handling sleeves of one height to handling sleeves of a different height is that of the filling volume. At the station 10, the sleeves 2 are lowered against the frictional forces holding them, until the pocket 1' is located immediately below the top closure sub-panels 201 of the sleeve. Thus, the sleeve having previously been held at a location suitable for operations upon its bottom closure, it is now held at a location suitable for operation upon its top closure.

The sleeve is now given a dosage of substance, for example milk, at the filling station 11 and then, depending upon the carton capacity, possibly another at the station 12. Alternatively, the station 11 can be arranged to give a single dosage in the case of a minimum capacity carton and multiple dosages in the case of greater capacity cartons.

The design of the station 13 is similar in principle to that of the station 5, although its heating element will not have the same shape as the heating element 24 and its depth of insertion will not be the same.

Figure 11:
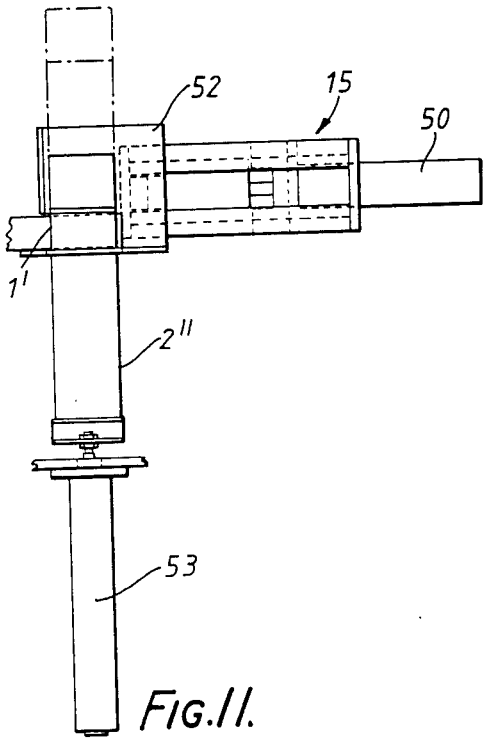
FIG. 11 shows a diagrammatic front elevation of an ejection station.
Figure 12:
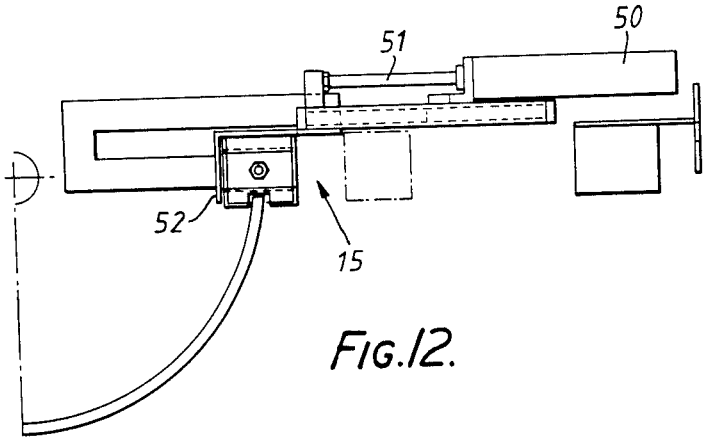
FIG. 12 shows a diagrammatic plan view of the ejection station.

The ejection station 15 is shown in more detail in FIGS. 11 and 12. It includes a pneumatic piston-and-cylinder device 50 to the piston rod 51 of which is connected a bracket 52. Below the stopped position of the pockets 1' at the station 15 is a vertical piston-and-cylinder device 53 arranged at right angles to the device 50. When the carton 2" reaches that position, the device 53 is operated to lift the carton so that its bottom is at a level which is identical irrespective of the height of the carton. Then the device 50 is operated to cause the bracket 52 to draw the carton 2" onto a carton discharge arrangement.

Possible alternative versions of the machine will now be described.

The machine can be an aseptic packaging machine in which almost all of the operations on the sleeve take place in an aseptic chamber. For cleaning purposes, it is advisable that any slightly complex mechanism should be outside the chamber. For example, at the station 9, the mandrel 36 can be arranged within the aseptic chamber whilst the toggle mechanism is outside the aseptic chamber. For that purpose, as shown diagrammatically in dot-dash lines in FIG. 7, the mandrel 36 can be connected to the toggle mechanism via an elongate member 57 which extends through a wall 58 of the chamber. There would be arranged between the elongate member 57 and the wall 58 a sealing device 59 which could be in the form of steam jet nozzles or in the form of a liquid disinfectant barrier in a telescopic casing. Additionally or alternatively to the sealing device, the aseptic chamber can be pressurized and such pressure relied upon to prevent ingress of non-aseptic air between the elongate member and the wall.

In another version, there are two parallel rings of pockets arranged co-axially in a table and thus two parallel loops of cartons are advanced stepwise through the stations, which those parts of each station which act directly in relation to a sleeve being duplicated in a side-by-side manner at their station. Alternatively, sleeves can be advanced stepwise in pairs in each of which the sleeves are arranged fore-and-aft, in which case the station parts acting directly in relation to a sleeve would themselves be duplicated fore-and-aft. In a case where the mandrel 36 is duplicated, it is advisable that the block 44 should be resiliently mounted to cope with manufacturing and assembly tolerances in relation to the lowermost level attained by the bottom face of each head 38. The provision of such resilient mounting of the block 44 could be avoided by providing not just one toggle system for the two mandrels, but by providing a separate toggle system for each mandrel. It is also possible to use one or more stepping chain conveyors in place of the table.

Since the weight of filled, larger-capacity cartons may make them difficult to maintain frictionally at the desired level for operations at their tops, there can be arranged to move with the table 1 some means, for example radial spokes 54 indicated in FIG. 1, to support the bottoms of those tallest sleeves from the positioning and coding station to the ejection station, at which the cartons would be lifted from the spokes to bring their bottoms to the pre-fixed level of the discharge arrangement.

Figure 13:
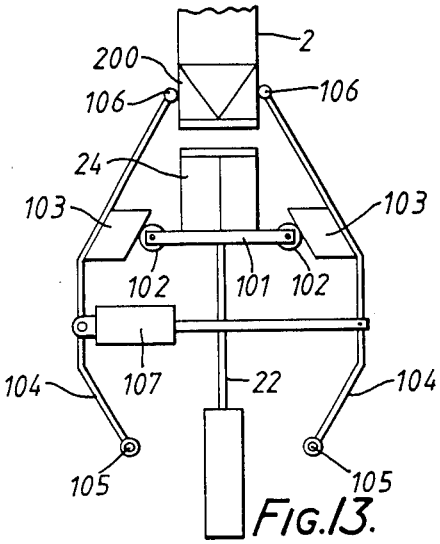
FIG. 13 shows a modified version of the bottom closure heating and top closure pre-breaking station.

In the modification shown in FIG. 13, the rod 22 is provided with a crosspiece 101 at the ends of which are mounted roller followers 102 arranged to ride upon respective cam blocks 103 fixed to respective arms 104 turnable about respective parallel pivots 105 at respective ends of the arms 104. The free ends of the arms 104 support respective cooled rails 106 which serve to fold the sub-panels 200. The arms 104 are interconnected by a single-acting, spring-return, pneumatic piston-and-cylinder device 107 operating perpendicularly to the vertical piston rod 22. The return spring in the device 107 tends to urge the arms 104 towards each other and thus presses the cam blocks 103 against the followers 102. The arrangement is such that the device 107 holds the rails 106 apart until the heating element 24 has been inserted into the sleeve 2. In that position, the followers 102 maintain the arms out of contact with the carton 2 even when the spring in the device 107 becomes effective to draw the arms towards each other. As the heater element 24 is then withdrawn from the carton 2, the shape of the cam blocks 103 allows the rails 106 to fold the sub-panels 200 just as the element 24 has left the sleeve 2.

Figure 14:
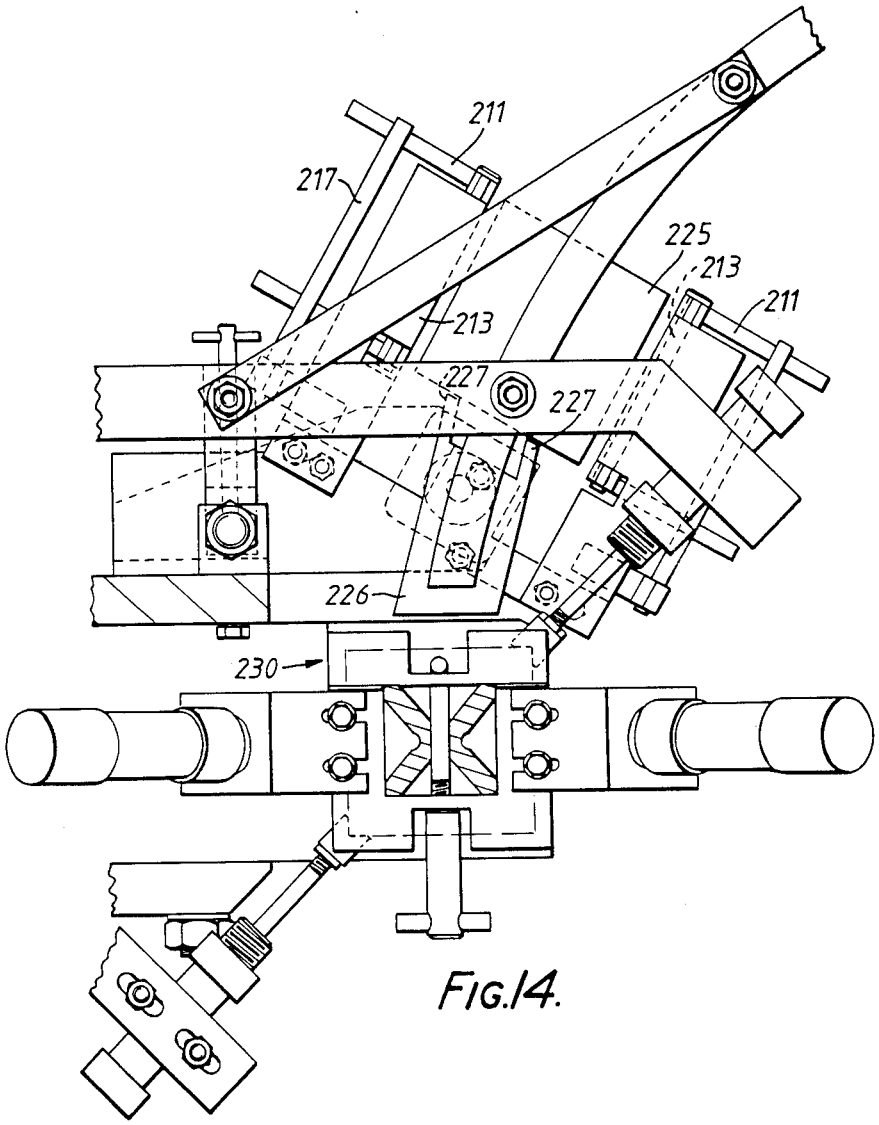
FIG. 14 shows a plan view of an alternative bottom closure heating and folding station and a bottom closure sealing station.
Figure 15:
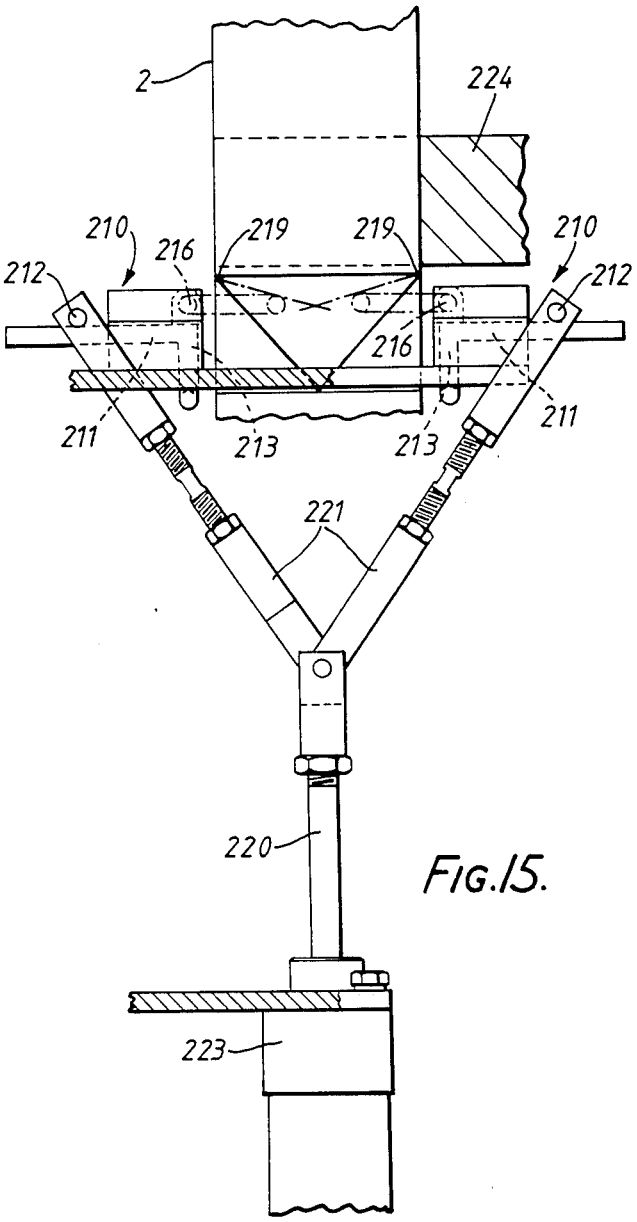
FIG. 15 shows the bottom closure heating and folding station in cross-section, taken as indicated by the arrows A in FIG. 14.
Figure 16:
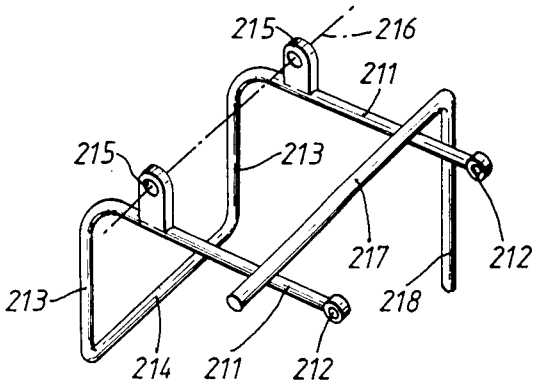
FIG. 16 shows diagrammatically the principle of the folding means of the bottom closure heating and folding station.

FIGS. 14 to 16 show two folding members 210 each made of tubing, through which a coolant is passed. In each case (see FIG. 16) the member 210 has parallel arms 211 which are pivotally mounted at one end 212 and have their other ends interconnected by parallel arms 213, perpendicular to the arms 211, and by a connecting piece 214, perpendicular to the arms 211 and 213. The arms 211 have pivotal connections 215, with a common pivot axis 216, and parallel to that there is a rod 217 welded to the arms 211 and pivotally connected to an operating member 218 which, when it moves downwardly, causes each member 210 to turn about the axis 216, which is not far from the axis 219 about which it is desired to turn the sealing sub-panel at the bottom of the sleeve. The arms 213 engage the sealing sub-panels near the edge of the box and fold the sub-panels inwardly when the members 210 are swung by a rod 220 coupled to them, via rods 221 and the pivotal connections 212, being moved downwardly by a piston and cylinder device 223. The rotary table is referenced 224 and the heater 225.

When the sleeve passes from the bottom closure heating and folding station to the sealing station 230 in which the already adhering surfaces are to be pressed together, these surfaces are prevented from springing apart by the bottom closure being pressed lightly against a plate 226 having ears 227, so that the bottom of the sleeve 2 slides over the plate 226.

Figure 18:
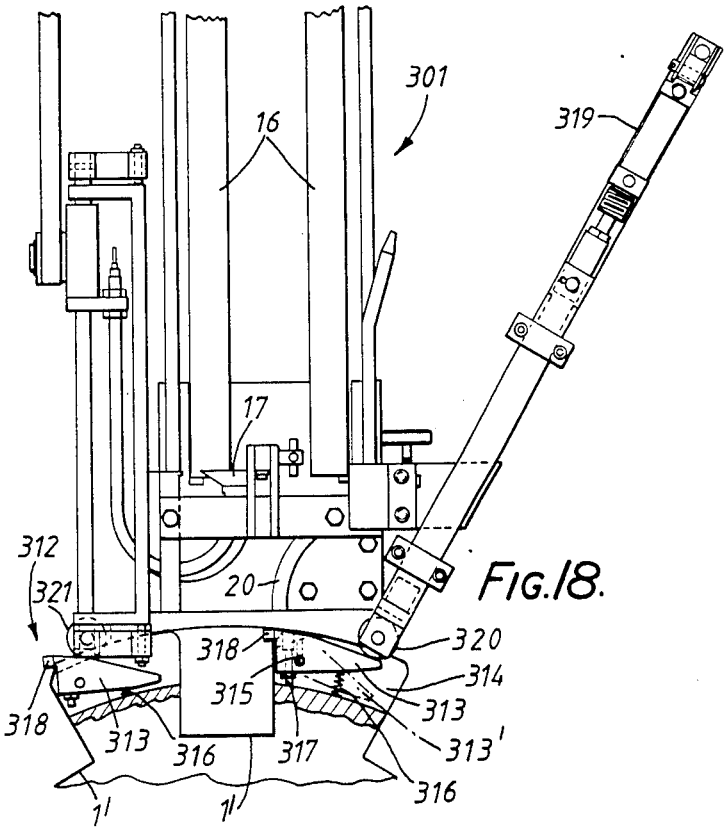
FIG. 18 shows a diagrammatic plan view of a carton sleeve introduction and opening station of the modified version and of part of an ejection station thereof.
Figure 17:
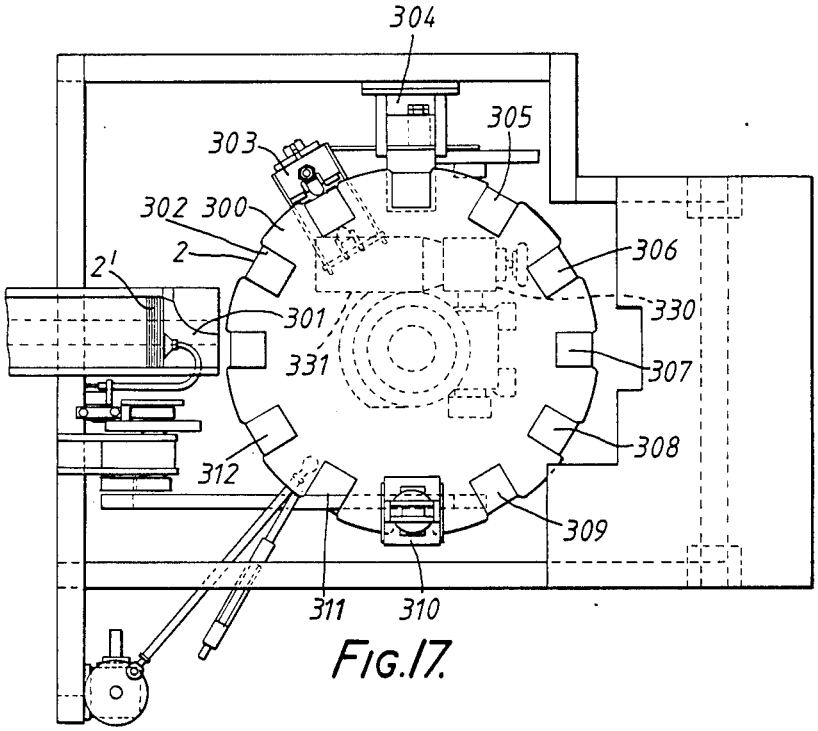
FIG. 17 shows a view similar to FIG. 1 of a modified version of the machine.
Figure 19:
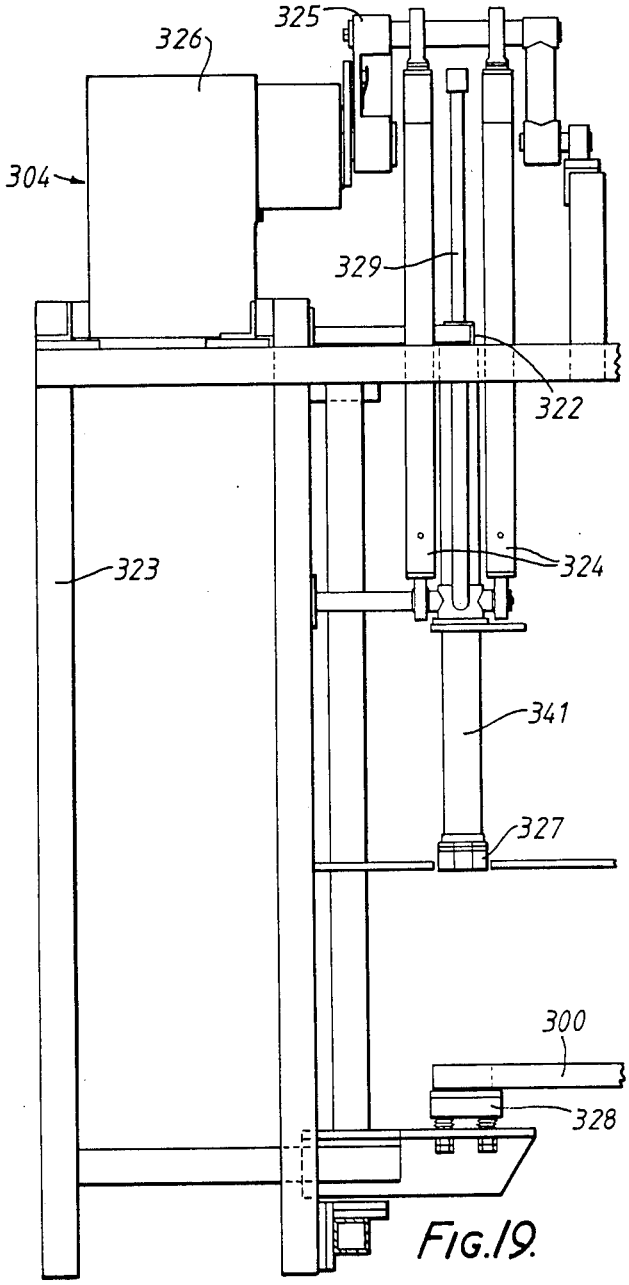
FIG. 19 shows a diagrammatic side elevation of a bottom closure sealing station of the machine.

Referring to FIGS. 17 to 19, in particular FIG. 17, the modified version has twelve equi-distantly distributed stations 301 to 312. It again includes a horizontal rotary table 300 in the outer periphery of which are formed the twelve radially outwardly opening rectangular pockets, for receiving the vertical rectangular carton sleeves 2. The sleeves 2' of a flat form are opened and loaded into a table pocket at the opening and loading station 301. The table 300 rotates stepwise (30° at each step) and the sleeve is advanced to a bottom closure heating station 302 at which the appropriate surfaces of sealing sub-panels of the carton bottom closure are heated to a tacky consistency. This station may be of a conventional form. The sleeve is advanced through another step to a bottom folding station 303, which may be of a substantially conventional form and at which the sleeve top is centred, a mandrel plate is inserted to assist in folding-in the bottom closure sub-panels, the bottom closure sub-panels are folded-into tack them together and the plate is withdrawn. The station 303 is followed by a bottom closure sealing station 304, which is followed by a positioning and coding station 305 which is identical to the station 10. Next is a top closure prebreaking station 306 which may be of a conventional form. Following the station 306 is a filling station 307 which is followed by a further station 308 which may be either a spare station for performing some additional operation in relation to the sleeve, or a second filling station. Each filling station may be of a conventional form. After the station 308 is a top closure heating station 309 which may be of a conventional form and which is followed by a top closure sealing station 310 which can also be of a conventional form. Following this is a spare station 311 and an ejection station 312.

The station 301 is shown in more detail in FIG. 18, in which again a block of flat-form sleeves in a substantially upright condition is guided along the horizontal rails 16 to an opening-out location at which is initially situated the vertical line of suction cups 17 which seize one of the four vertical major panels of the flat-form sleeve and which open out the sleeve by pulling it past the curved guide surface 20. The aforementioned latch can be arranged in the manner shown in FIG. 18. The latch, referenced 313, is pivotally mounted in a horizontal slot 314 in the rim of the table 300, upon a vertical pivot pin 315, a helical compression spring 316 urging the latch 313 in an anti-clockwise sense into a retaining position which can be adjusted by means of a set screw device 317 and in which a lug 318 of the latch 313 presses externally on the radially outermost panel of the sleeve to press the radially innermost panel of the sleeve against the radially innermost surface of the pocket 1'. To open the latch 313 against the action of the spring 316 when the associated pocket 1' has arrived in its stationary position at the station 301, a piston-and-cylinder device 319 presses a roller 320 horizontally against the latch 313 to swing the latch 313 clockwise from the full-line position shown in FIG. 18 into the broken-line position 313'. The suction cups 17 then pull the opened-out sleeve into the pocket 1', whereupon the device 319 retracts the roller 320, so that the latch 313 turns anti-clockwise into its full-line position shown. the latch 313 remains in this position relative to the pocket 1' throughout the stepping of the table 300 until the ejection station 312 is approached. Resiliently mounted upon framework of the station 301 is, at the station 312, a roller 321 which, in the stationary position of the pocket 1' at the station 312, presses the latch 313 clockwise against the action of the spring 316 to remove the lug 318 from the patch of movement of the filled and sealed carton out of the pocket.

Following the substantially conventional station 303 is the station 304 which is a modified version of the station 9 and is shown in more detail in FIG. 19. A vertical, tubular mandrel 341 is guided vertically upon an internal sleeve 322 which is fixed to a supporting framework 323. The mandrel 341 is reciprocated vertically by way of connecting rods 324 by a crank 325 which is itself rotated by means of a drive in the form of an index box 326 comprising a globoidal gear assembly. For every 360° rotation by the input shaft to the box 326, 240° is a dwell by the crank 325 and 120° is a 180° rotation by the crank 325. This box is designed to produce this crank motion with predetermined acceleration and deceleration, selected to minimize shock and vibration. The mandrel 341 is closed at its lower end by a head 327 which co-operates with a fluid-cooled anvil 328 and to which is fixed coolant ducting 329 extending co-axially of the guide sleeve 322. Referring to FIG. 17, the table 300 is driven stepwise by way of an index box 330 also comprising a globoidal gear assembly. The index boxes 326 and 330 are driven positively by a common drive motor 331. These drive arrangements for the vertical reciprocation of the mandrel 341 and for the stepping advance of the table 300 are such as to produce positively controlled motion patterns of the mandrel 341 and the table 300 in which the reciprocatory cycle frequency of the mandrel 341 equals the stepping frequency of the table 300, with an upper dwell and a lower dwell for the mandrel 341, and the stepping motion of the table 300 occurring at the upper dwell of the mandrel 341.

I claim:

1. A method of performing sequential operations in relation to a container sleeve having an upper end and a lower end, in which method the container sleeve is advanced stepwise through a series of stations at which stations different operations are performed, said method comprising the steps of:

performing at a first of the stations a preselected operation on said lower end of the sleeve with the lower end being disposed at a first desired level;

adjusting the disposition of the sleeve vertically subsequent to completion of said operation at said first station by an amount determined by its height so as to bring said upper end to a second desired level; and performing at a subsequent station a preselected operation on said upper end of the sleeve with the upper end being disposed at said second desired level.

2. A method according to claim 1 wherein the step of adjusting of the sleeve vertically comprises a step of lowering the sleeve until its lower end bears upon supporting means which supports said sleeve during the operation upon its upper end.

3. A method according to claim 2 wherein said supporting means is moved with conveying means conveying said sleeve from said one station to said second station.

4. A method according to claim 1 which includes performing operations in relation to container sleeves of differing heights comprising advancing the container sleeves towards an ejection station with their upper ends at a substantially identical level irrespective of their heights and advancing the container sleeves away from the ejection station with their lower ends at a lower substantially identical level irrespective of their heights.

5. A method according to claim 1 wherein one operation upon the container sleeve includes moving the sleeve to an operating station, causing at said station a member to be received in an end of the sleeve so that said member is closely received in the internal cross section of said end, and immediately prior to such reception, applying a force externally upon said sleeve in such a manner that the internal cross section of said sleeve is caused to have a preselected shape to receive said member, and moving the sleeve away from said station.

6. A method according to claim 1 which includes filling with a dosaging device container sleeves of which some have a contents volume a multiple of that of others, for each sleeve having a minimum contents volume, operating once only the dosaging device and, for each of said other sleeves, operating said dosaging device a multiple of times.

7. Apparatus for performing sequential operations in relation to a container sleeve having an upper end and a lower end, in which method the container sleeve is advanced stepwise through a series of stations at which stations different operations are performed, said apparatus comprising:

means for performing at a first of the stations a preselected operation on said lower end of the sleeve with the lower end being disposed at a first desired level;

adjusting means for adjusting the disposition of the sleeve vertically subsequent to completion of said operation at said first station by an amount determined by its height so as to bring said upper end to a second desired level; and means for performing at a subsequent station a preselected operation on said upper end of the sleeve with the upper end being disposed at said second desired level.

8. Apparatus according to claim 7 further comprising supporting means disposed beneath said adjusting means for bearing the lower end of said sleeve.

9. Apparatus according to claim 8 further comprising conveying means for conveying said sleeve from said first station to said subsequent station, and means for causing said supporting means to move with said conveying means.

10. Apparatus according to claim 7 arranged for performing operations in relation to containers of differing heights, said apparatus further comprising a zone, conveying means for advancing said container sleeves towards said zone and away from said zone, and means to cause the upper end of the container sleeves as they approach said zone to be at a substantially identical level irrespective of the heights of the container sleeves and to cause the lower ends of the container sleeves as they leave said zone to be at a substantially identical level irrespective of the heights of the container sleeves.

11. Apparatus according to claim 7 which includes means for retaining a container sleeve which has been made by folding sheet material having an inherent tendency to unfold, in a desired position, said retaining means including a releasable latching member for releasably bearing against an external surface portion of said sleeve which tends to move outwardly under said tendency, and mounting means which mounts said member for displacement to release said sleeve.

12. Apparatus according to claim 7 including, at another station, means for folding towards a closed position thereof a closure sealing subpanel of a container sleeve having surfaces of a material which can be rendered tacky by heating, and means for heating said subpanel to render tacky a surface portion thereof.

13. Apparatus according to claim 7 which includes, at another operating station, a member for being received in an end of said sleeve and of a section, in a transverse plane of said sleeve, of a shape and size to be received closely in the internal cross section of said end and means arranged to bear externally upon said sleeve at said end in such a manner that the internal cross section of said sleeve is of a shape to receive said member, said member and means being movable to permit the sleeve to be moved into and out of said operating station.

14. Apparatus according to claim 7 including, at one station, a support, a press member displaceable longitudinally for applying pressure to portions of said sleeve, a toggle device comprising first and second interarticulated links of which the first is connected to the support and the second is connected to the member, and driving means connected to the first and second links in the zone of interarticulation for displacing said links so as to displace said member longitudinally.

15. Apparatus according to claim 14 further comprising an aseptic chamber having a wall, and an elongate member extending longitudinally displaceably through said wall, said press member being situated within said chamber, said toggle device being situated outside said chamber, and said elongate member interconnecting said press member and said toggle device.

16. Apparatus according to claim 7 comprising, at one station, a mandrel mounted so as to be displaceable up and down for lowering longitudinally into said sleeve, driving means operable by fluid pressure to raise said mandrel, a fluid pressure line for supplying said fluid to said driving means, an exhaust for allowing said fluid escape from said driving means on lowering of said mandrel, an openable safety guard which in a closed position is interposed between said mandrel and an operator, and valve means arranged in said exhaust and so connected to said guard as to close said exhaust upon opening of said guard.

17. Apparatus according to claim 7 comprising, at one station, a tubular mandrel closed at an end and for entering longitudinally into said sleeve, elongate guide means arranged substantially coaxially in said mandrel for guiding reciprocation of said mandrel along said guide means, and drive means arranged to reciprocate said mandrel along said guide means.

18. Apparatus according to claim 7 comprising a mandrel mounted so as to be displaceable up and down for lowering longitudinally into such sleeve, mandrel driving means connected to said mandrel for displacing said mandrel up and down, stepping conveying means arranged beneath said mandrel for advancing the sleeves stepwise in turn to and from a stationary position substantially coaxial with said mandrel, second driving means connected to said stepping conveying means for advancing the latter stepwise, and common driving means arranged to drive the mandrel driving means and the second driving means, these three driving means being such as to produce controlled motion patterns of said mandrel and said stepping conveying means in which the reciprocatory cycle frequency of the mandrel equals the stepping frequency of the stepping conveying means, with an upper dwell and a lower dwell for the mandrel, and the stepping motion of the stepping conveying means occurring at the upper dwell.

19. Apparatus according to claim 7 wherein said adjusting means comprises means for lowering the sleeve.

* * * * *